US008851640B2

(12) United States Patent
Takeuchi et al.

(10) Patent No.: US 8,851,640 B2
(45) Date of Patent: Oct. 7, 2014

(54) INK JET RECORDING APPARATUS

(71) Applicant: Seiko Epson Corporation, Tokyo (JP)

(72) Inventors: Hiroshi Takeuchi, Matsumoto (JP); Hiroyuki Yoda, Shiojiri (JP); Kenji Oshima, Nagano (JP); Yoshisada Aoki, Azumino (JP); Satoshi Shimizu, Shiojiri (JP); Kazutoshi Sakamoto, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/779,224

(22) Filed: Feb. 27, 2013

(65) Prior Publication Data

US 2013/0235126 A1 Sep. 12, 2013

(30) Foreign Application Priority Data

Feb. 28, 2012 (JP) ..... 2012-041920
Mar. 1, 2012 (JP) ..... 2012-045109

(51) Int. Cl.
*B41J 2/175* (2006.01)

(52) U.S. Cl.
CPC ..... *B41J 2/175* (2013.01); *B41J 2/17523* (2013.01); *B41J 2/17509* (2013.01)
USPC ..... 347/85

(58) Field of Classification Search
USPC ..... 347/85
See application file for complete search history.

(56) References Cited

U.S. PATENT DOCUMENTS 5,467,114 A 11/1995 Ebinuma et al.
2003/0184771 A1* 10/2003 Yamamoto et al. ..... 358/1.7
2004/0125182 A1* 7/2004 Akermalm ..... 347/85
2006/0082622 A1* 4/2006 Yonekawa et al. ..... 347/85
2006/0203045 A1 9/2006 Kobayashi et al.
2006/0284945 A1 12/2006 Kobayashi et al.
2012/0038719 A1 2/2012 Shimizu et al.

FOREIGN PATENT DOCUMENTS

| | | |
|---|---|---|
| JP | 63-146657 | 6/1988 |
| JP | 2006-305940 | 11/2006 |
| JP | 2007-067627 | 3/2007 |
| JP | 2010-131893 | 6/2010 |
| JP | 2012-061620 | 3/2012 |
| JP | 2012-076224 | 4/2012 |
| WO | 2006-082836 | 8/2006 |
| WO | 2011-129123 | 10/2011 |

OTHER PUBLICATIONS

The key to victorious is using imaginative power. How to make the ink cost of a printer cheap certainly, [online], 2007.16.17, [retrieval day: Mar. 29, 2013], Internet, <URL:http://inkmiyax.blog81.fc2.com/blog-entry-77.html>.

Follow-up: In the case of the formation of continuation supply, and iP3300 How to make the ink cost of a printer cheap certainly, [online], May 8, 2007, [retrieval day: Mar. 29, 2013], Internet, <URL:http://inkmiyax.blog81.fc2.com/blog-entry-73.html>.

* cited by examiner

*Primary Examiner* — Stephen Meier
*Assistant Examiner* — Alexander D Shenderov
(74) *Attorney, Agent, or Firm* — Workman Nydegger

(57) ABSTRACT

An ink jet recording apparatus includes a head unit, a discharge port including a region where a recording medium on which a recording is performed by the recording head is discharged and an ink tube having flexibility, that is connected to the head unit and leads the ink from an ink containing unit. The ink tube protrudes to the outside of the apparatus from discharge port side of the front surface.

17 Claims, 9 Drawing Sheets

INK JET RECORDING APPARATUS

TECHNICAL FIELD

The present invention relates to an ink jet recording apparatus represented by a facsimile or a printer, particularly to an ink jet printer that includes a head unit provided with a recording head and capable of moving in a predetermined moving direction, an ink containing unit independent of the head unit and an ink tube that forms a ink flow path between the head unit and the ink containing unit.

BACKGROUND ART

Particularly as an ink jet recording apparatus among recording apparatuses represented by a facsimile and a printer, there is a so called serial type ink jet recording apparatus that includes a recording head which ejects an ink and a head unit (in some cases, referred to as a carriage) capable of moving in a predetermined moving direction.

Now, there are two types of head units; one is a head unit on which an ink containing unit for containing the ink (hereafter, appropriately referred to as an ink cartridge) is mounted, and the other is one on which the ink cartridge is not mounted.

The head unit with the cartridge mounted thereon reciprocates in a predetermined direction in a state of the ink cartridge being mounted on, and the ink is supplied from the ink cartridge to the recording head, in the inside of the head unit. In the head unit without the cartridge mounted thereon, the ink cartridge is provided independent of the head unit, and the ink cartridge and the head unit (recording head) communicate with each other through the ink tube provided for supplying the ink. (For example, refer to PTL 1)

CITATION LIST

Patent Literature

[PTL 1] JP-A-2010-131893

SUMMARY OF INVENTION

Technical Problem

In the ink jet recording apparatus, one end side of the ink tube is connected to the head unit and the other end side is connected to the ink containing unit. The ink tube is extended from the head unit and is routed along the moving direction of the head unit, that is, main scanning direction, and is extended to the ink containing unit.

Here, for the layout of the apparatus, there is a case that at least a part of the ink tube should be protruded to the outside of the apparatus. In this case, when the ink tube protruded to the outside of the apparatus is crushed by an object located around the apparatus, the ink flow path is blocked. As a result, the recording cannot be performed.

The invention is made in consideration of the above circumstances, and an object of the invention is to make the ink tube which protrudes to the outside of the apparatus be placed in an appropriate state.

Solution to Problem

In order to accomplish the above object, an ink jet recording apparatus according to the first aspect of the invention includes a head unit provided with a recording head ejecting an ink and capable of moving in a predetermined moving direction, a discharge port including a recording medium discharge region where the recording medium on which a recording is performed by the recording head is discharged and an ink tube having flexibility, that is connected to the head unit and leads the ink from an ink containing unit. The ink tube protrudes to the outside of the apparatus from discharge port side of the front surface.

According to the aspect, the ink tube that leads the ink from the ink containing unit to the recording head protrudes to the outside of the apparatus from the front surface side of the apparatus. Accordingly, the ink tube protruding to the outside of the apparatus is easily visible by a user. Therefore, a risk of the ink tube being crushed by an object located around the apparatus can be decreased. Thus, it is possible to maintain the ink tube in a proper state.

In the second aspect of the invention, according to the first aspect, the discharge port is configured to include the recording medium discharge region and a space other than the recording medium discharge region.

In the third aspect of the invention, according to the second aspect, the ink tube protrudes to the outside of the apparatus through the space other than the recording medium discharge region of the discharge port.

In the fourth aspect of the invention, according to the second aspect, the ink tube protrudes to the outside of the apparatus from the recording medium discharge region.

In the fifth aspect of the invention, according to the third aspect, the recording medium discharge region and the space other than the recording medium discharge region are partitioned by a partitioning member, and the ink tube is disposed along the partitioning member.

In the sixth aspect of the invention, according to the fifth aspect, the partitioning member is a plate-shaped member forming a surface, in the recording medium discharge region, along a horizontal surface having a predetermined gap from the placement surface, and the space other than the recording medium discharge region is formed by the partitioning member.

In the seventh aspect of the invention, according to the fifth aspect, the partitioning member is a plate-shaped member forming an outer side of the recording medium discharge region, and the space other than the recording medium discharge region is formed on the left side or the right side of the recording medium discharge region by the partitioning member.

In the eighth aspect of the invention, according to the first aspect, the ink tube is disposed along the side wall configuring the discharge port.

In the ninth aspect of the invention, according to the first aspect, a panel unit configuring an operation unit of the apparatus on the front surface of the apparatus, and an upper edge of the discharge port is configured on the lower end of the panel unit.

In the tenth aspect of the invention, according to the ninth aspect, a scanner unit is rotatably mounted on an upper part of the apparatus main body configuring the ink jet recording apparatus, and the panel unit is provided on the scanner unit.

In the eleventh aspect of the invention, according to the ninth aspect, the ink tube is mounted on the lower end of the panel unit.

In the twelfth aspect of the invention, according to the first aspect, in the ink jet recording apparatus, a discharger that discharges the recording medium on which a recording is performed is provided at an inner side of the discharge port. The discharger is configured to include a drive roller and a driven roller which is in contact with the drive roller from the top thereof, and the ink tube protrudes to the outside of the apparatus through the upper part of a support member which supports the driven roller.

In the thirteenth aspect of the invention, according to the twelfth aspect, a regulation member which regulates the position of the ink tube is provided on the support member.

In the fourteenth aspect of the invention, according to the first aspect, the ink tube is supported by the side wall configuring the discharge port.

In the fifteenth aspect of the invention, according to the first aspect, in the ink jet recording apparatus, a plurality of the ink tubes are provided and the plurality of ink tubes are bound together by a binder.

In the sixteenth aspect of the invention, according to any one of the first to fifteenth aspects, in the ink jet recording apparatus, an ink containing unit is provided at the outside of a housing which configures an external appearance of the apparatus.

In the seventeenth aspect of the invention, according to the first aspect, in the ink jet recording apparatus, when a flexible data line which sends a data signal for performing the recording to the head unit is provided and the side where the discharge port is provided is used as a front side of the apparatus, the data line is disposed on the rear side with respect to the head unit. The ink tube is disposed on the front side with respect to the head unit and protrudes to the outside of the apparatus from the front surface of the apparatus.

In the eighteenth aspect of the invention, according to the first aspect, in the ink jet recording apparatus, a tube support member for supporting the ink tube in contact with a part of the ink tube is present at the rear side of the panel unit. The ink tube is supported by the tube support member and protrudes to the outside of the apparatus.

In the nineteenth aspect of the invention, according to the eighteenth aspect, the discharge port is vertically or horizontally partitioned by the tube support member provided at such a position where discharging of the recording medium is not interfered with, and a part of the ink tube is supported by the tube support member and protrudes to the outside of the apparatus.

In the twentieth aspect of the invention, according to the nineteenth aspect, the tube support member is a plate-shaped member forming a surface along the horizontal plane, and a tube arrangement region is formed on the upper part of the discharge port by the tube support member.

In the twenty first aspect of the invention, according to the nineteenth aspect, the tube support member is a plate-shaped member forming a surface along the vertical plane, and the tube arrangement region is formed on the left or right side of the discharge port by the tube support member.

DESCRIPTION OF EMBODIMENTS

Hereinafter, the embodiments of the invention will be described with reference to the drawings. In addition, in each of the embodiments, like configurations are referenced by like reference signs, and the description will be made only in the earliest embodiment. The description of the same configurations in the later embodiments will not be repeated.

Figure 1:
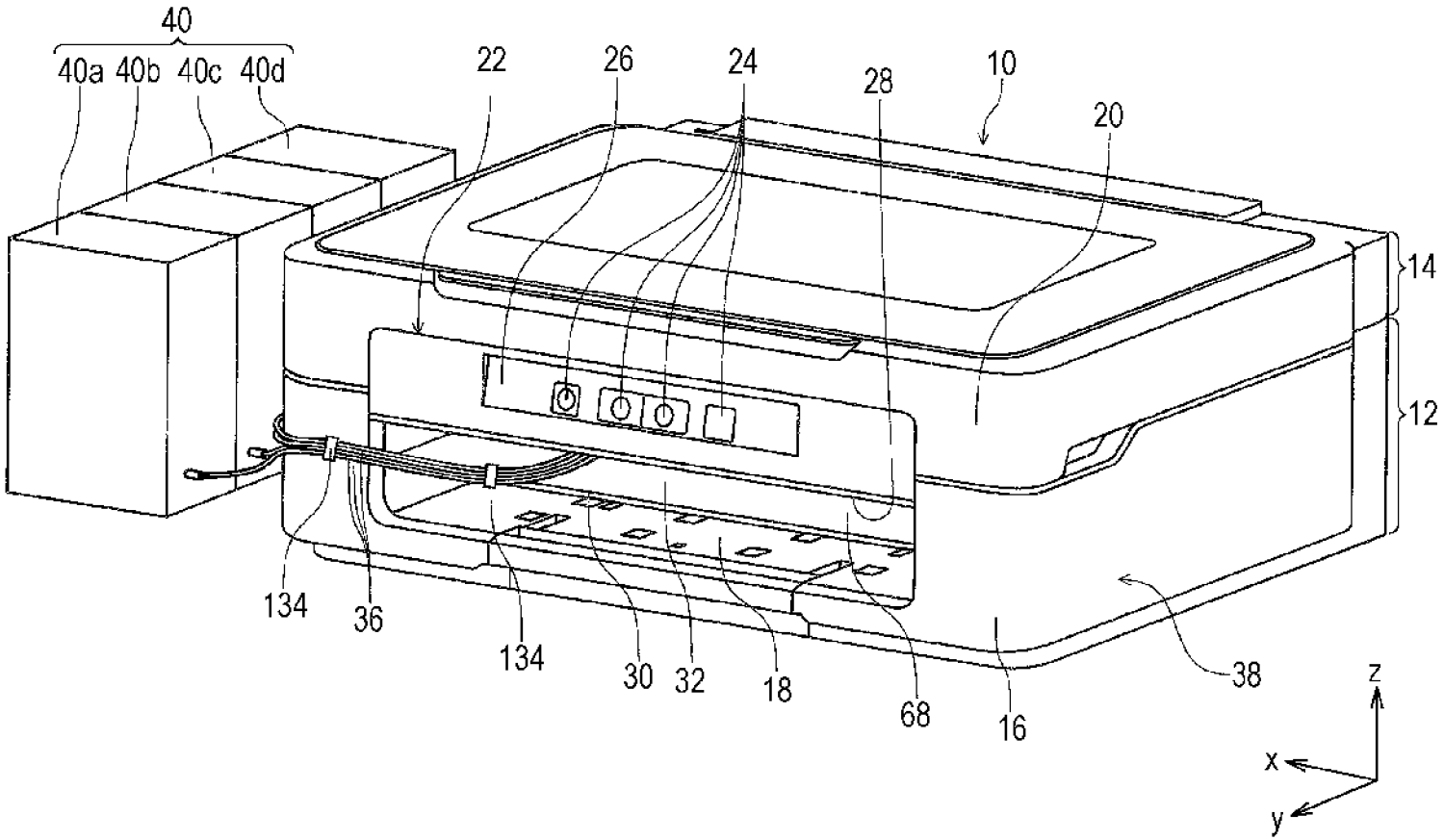
FIG. 1 is a perspective view of an ink jet printer according to the present invention.
Figure 2:
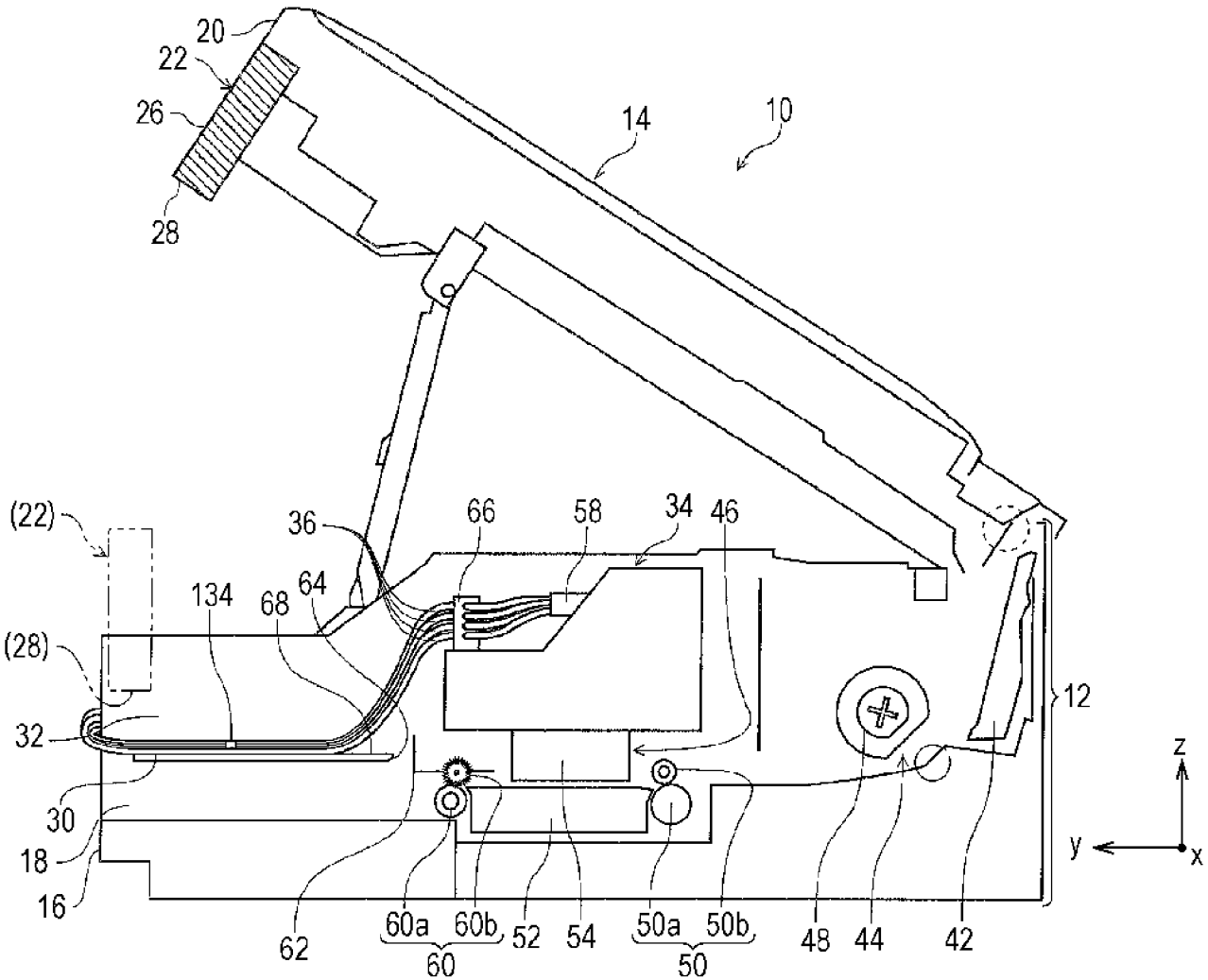
FIG. 2 is a sectional side view illustrating a schematic of inside of the ink jet printer according to the invention.
Figure 3:
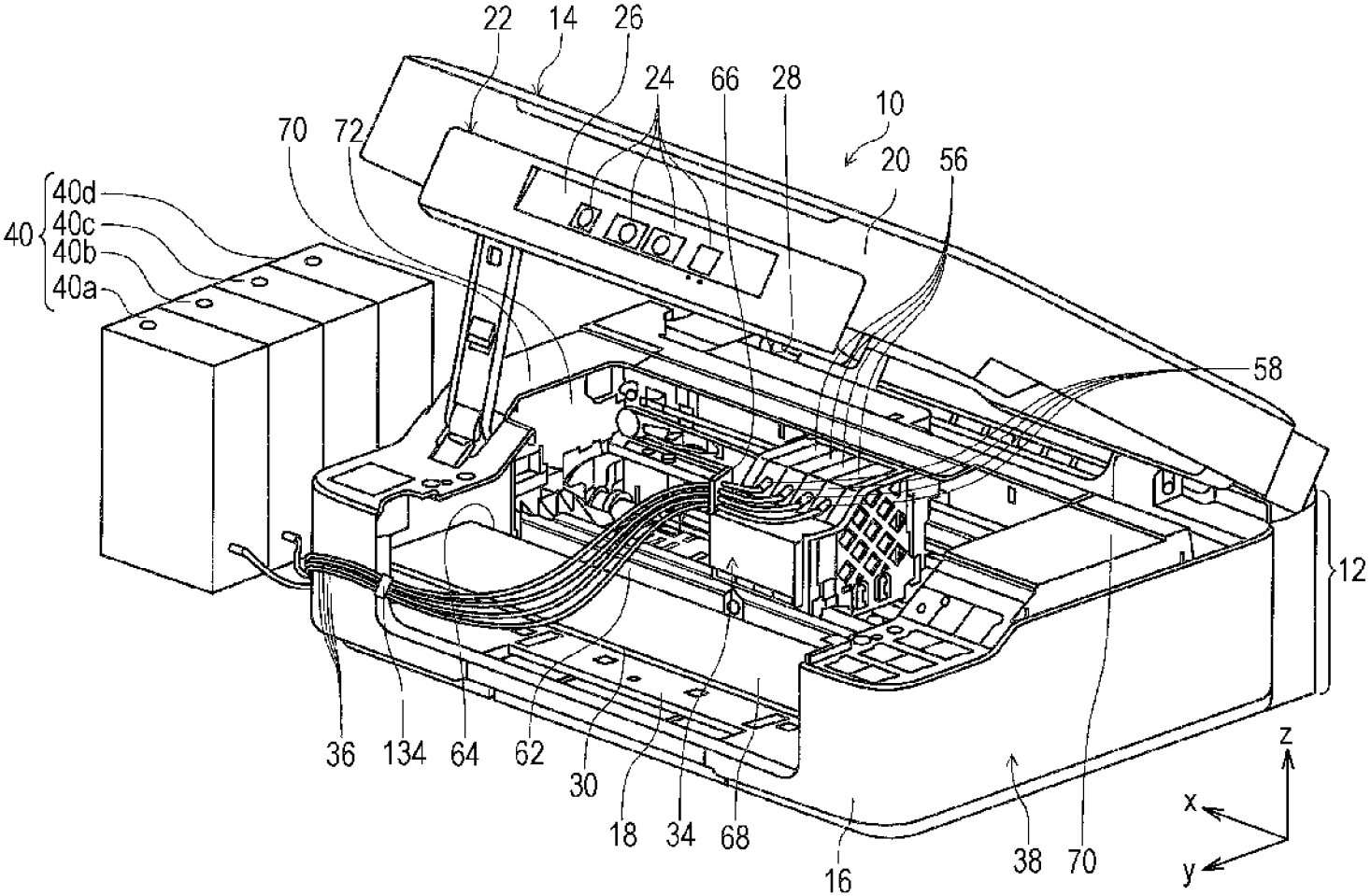
FIG. 3 is a perspective view illustrating an extending form of an ink tube extended from a housing in the first embodiment.

FIG. 1 is a perspective view illustrating an external appearance of an ink jet printer as an ink jet recording apparatus according to the invention, FIG. 2 is a sectional side view illustrating a schematic of the inside of the inkjet printer and FIG. 3 is a perspective view illustrating a form of an ink tube extended from a housing in the first embodiment.

Figure 4:
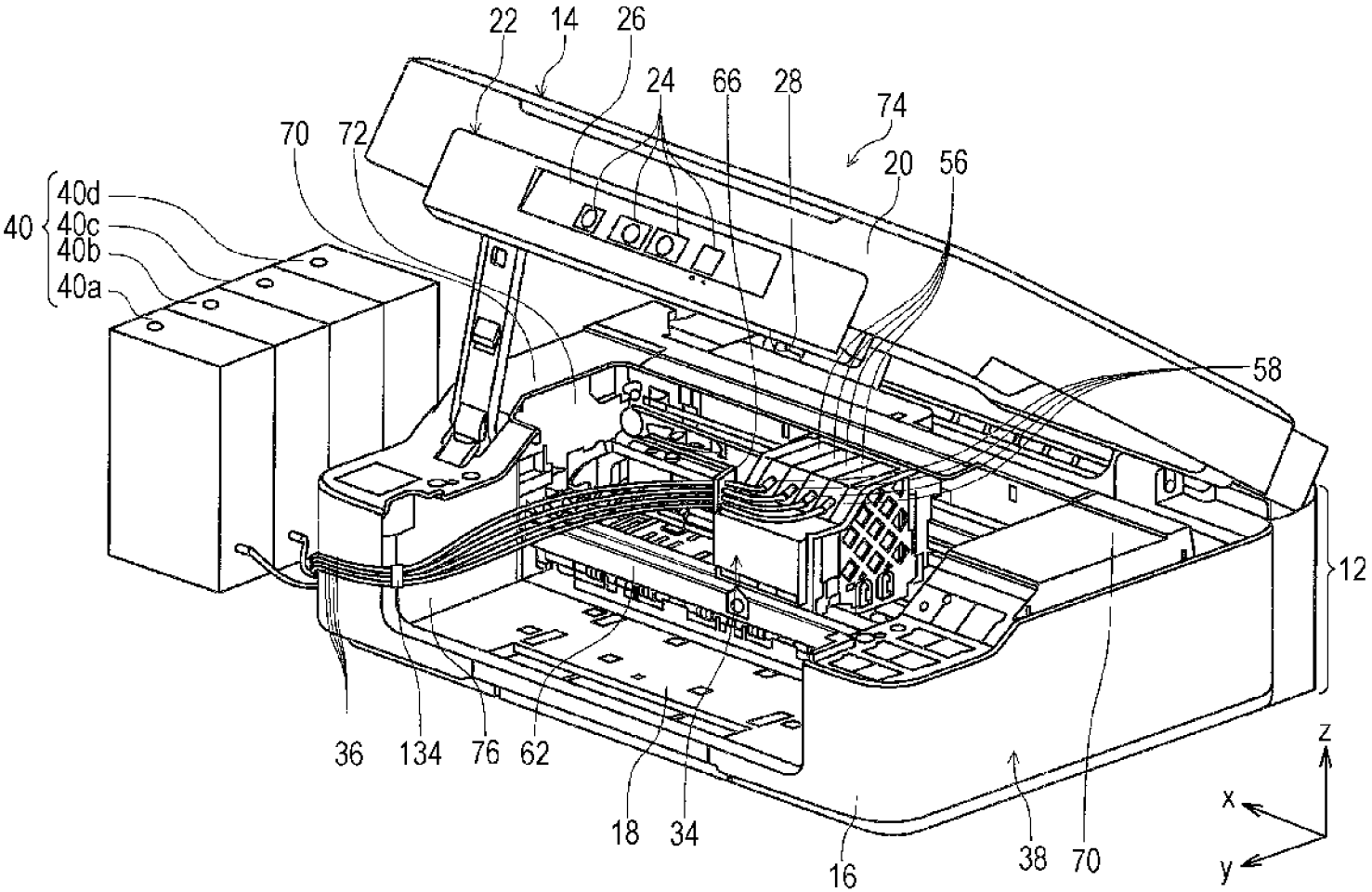
FIG. 4 is a perspective view illustrating an extending form of the ink tube extended from the housing in the second embodiment.
Figure 5:
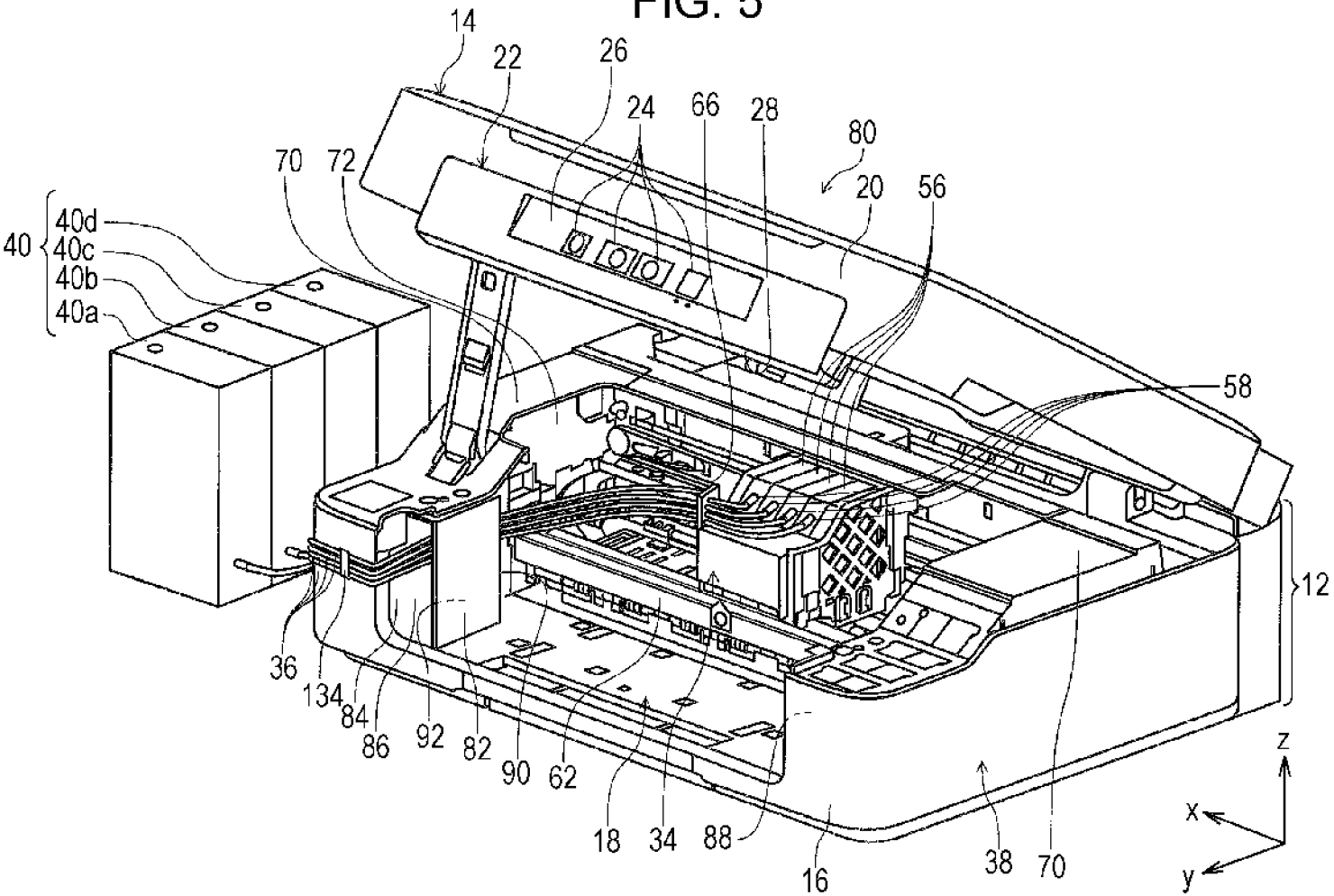
FIG. 5 is a perspective view illustrating an extending form of the ink tube extended from the housing in the third embodiment.
Figure 6:
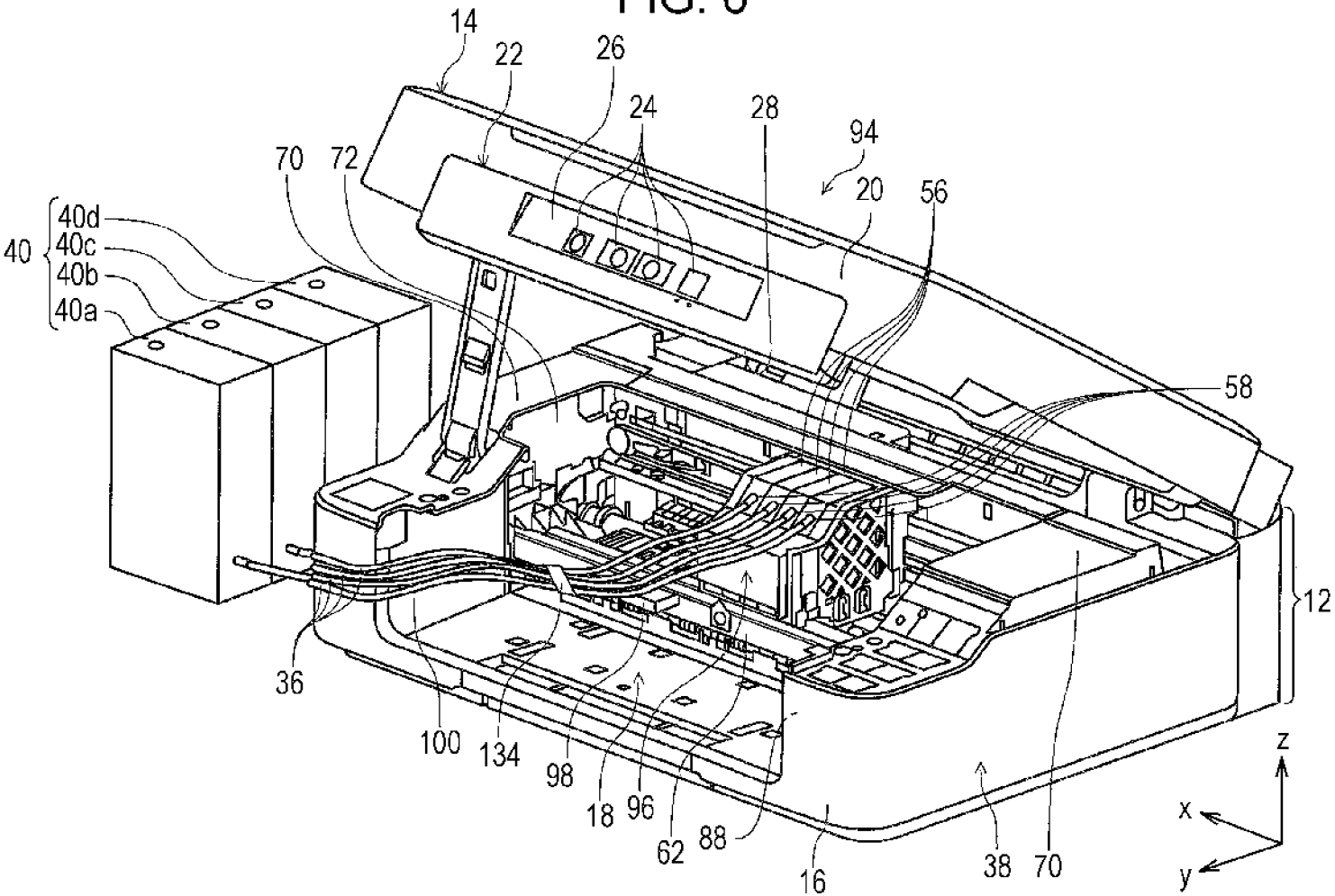
FIG. 6 is a perspective view illustrating an extending form of the ink tube extended from the housing in the fourth embodiment.
Figure 7:
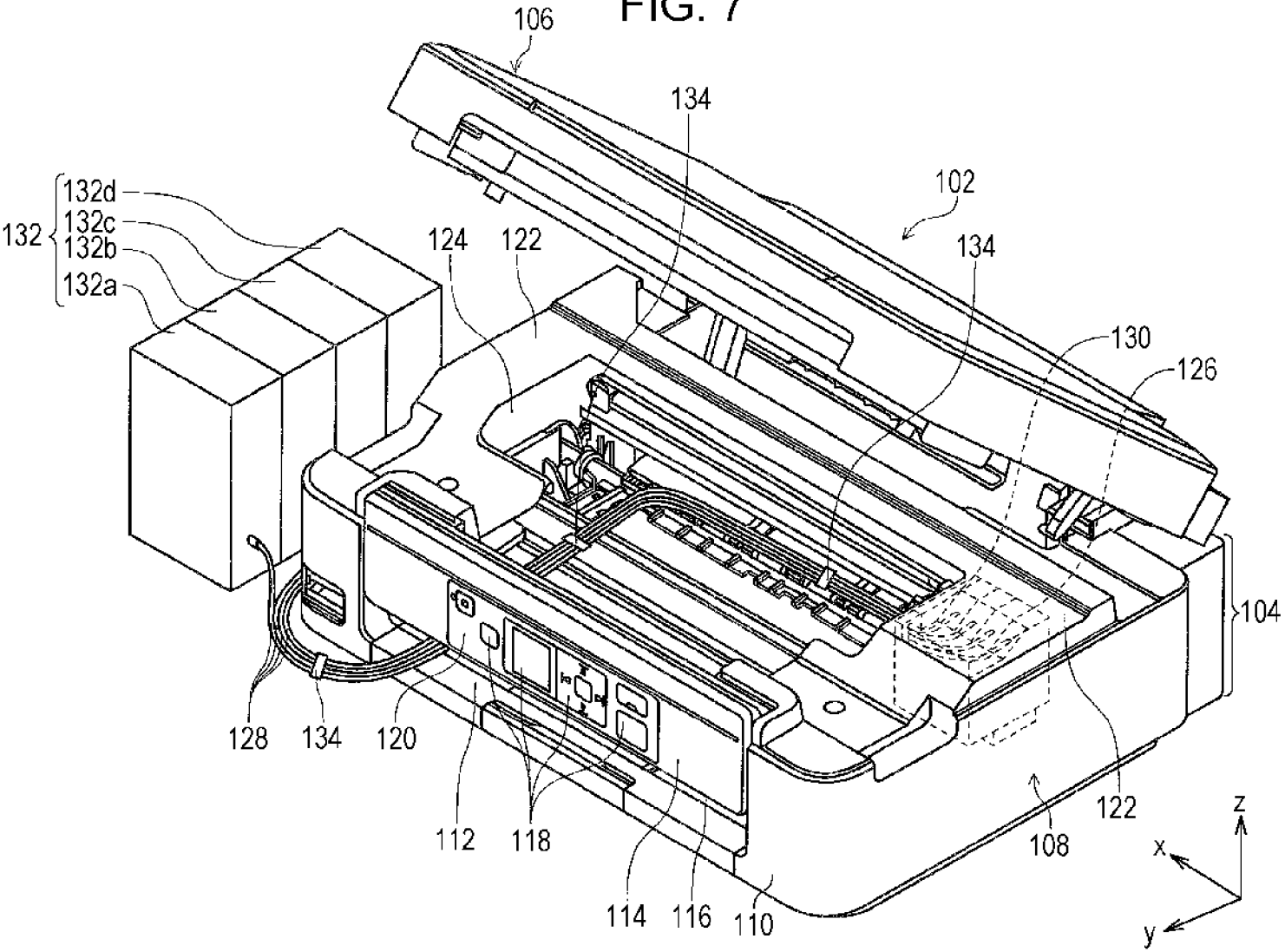
FIG. 7 is a perspective view illustrating an extending form of the ink tube extended from the housing in the fifth embodiment.

FIG. 4 is a perspective view illustrating a form of the ink tube extended from the housing in the second embodiment, FIG. 5 is a perspective view illustrating a form of the ink tube extended from the housing in the third embodiment, FIG. 6 is a perspective view illustrating a form of the ink tube extended from the housing in the fourth embodiment and FIG. 7 is a perspective view illustrating a form of the ink tube extended from the housing in the fifth embodiment.

FIRST EMBODIMENT

Referring to FIG. 1, the external appearance of the ink jet printer 10 (hereafter, referred to as a printer 10) according to the invention is illustrated. The printer 10 includes a printer apparatus main body 12 and a scanner unit 14 rotatably mounted on the upper part of the printer apparatus main body 12. The printer apparatus main body 12 includes a discharge port 18, in a front surface 16, which discharges a recording medium to the front surface thereof. The discharge port 18 is configured to include a sheet discharge region where a sheet as the recording medium is discharged and a space other than the sheet discharge region. In addition, the sheet discharge region is a region where the sheet passes when the sheet is discharged, and the space other than the sheet discharge region is a region where the sheet does not pass when the sheet is discharged, regardless of the size of the sheet. Usually, the size of the sheet discharge port is formed larger than the sheet size, and the sheet discharge port is configured to include the sheet discharge region where the sheet actually passes and the space other than the sheet discharge region.

The scanner unit 14 includes a panel unit 22 on the front surface 20 thereof. On the panel unit 22, a plurality of input means 24 for the operations of the printer 10 by a user is provided and configures an operation unit 26 of the apparatus. In addition, a lower end of the panel unit 22 configures an upper edge 28 of the discharge port 18 when the scanner unit 14 is closed with respect to the printer apparatus main body 12.

In the discharge port 18, a plate-shaped portioning member 30 is provided, extending in a direction along the horizontal surface, that is, the width direction of the printer 10 (x direction in FIG. 1). The partitioning member 30 partitions the discharge port 18 in a vertical direction of the printer 10 (z direction in FIG. 1), and forms a tube arrangement region 32 adjacent to the discharge port 18. In addition, in a case where the partitioning member 30 is not provided, the tube arrangement region 32 becomes a space other than the discharge region. That is, by providing the partitioning member 30, the discharge port 18 becomes a state of being vertically divided into the sheet discharge region and the space other than the sheet discharge region, and the tube arrangement region 32 configures the space other than the sheet discharge region.

In the printer apparatus main body 12, a head unit 34 capable of moving in a main scanning direction (x direction in FIG. 1) as described below, is disposed. To the head unit 34, one end side of a plurality of ink tubes 36 having flexibility is connected. The ink tube 36 extended from the head unit 34 is extended to the outer side of the printer 10 from the front surface 16 side of the printer apparatus main body 12 after passing the tube arrangement region 32.

The ink tube 36 extended to the outer side of the printer 10 changes the direction to the left and is extended to the left side of the printer 10 after passing along the front surface 16 of the printer apparatus main body 12.

In addition, a plurality of external ink containing units 40*a*, 40*b*, 40*c* and 40*d* are provided at a separated position on the left side of the printer 10, that is, the outer left side of the housing 38 which forms the external appearance of the printer 10. The other end sides of the ink tubes 36 extended to the left side of the printer 10 are connected to the ink containing units 40, respectively.

Referring to FIG. 2, at the back side of the printer 10, a hopper 42 on which the recording medium is stacked so as to swing with an upper part of the hopper 42 as a supporting point. The recording medium stacked on top of the hopper 42 is fed to a recording unit 46 on the downstream of the transportation direction by a feed unit 44.

Specifically, the recording medium stacked on the hopper 42 is picked up by a feed roller 48 driven by a feed motor (not illustrated), and is fed to a pair of transportation rollers 50 on the downstream side of the transportation direction. The recording medium fed to the transportation rollers 50 is pinched between the main transportation roller 50*a* driven by the feed motor (not illustrated) and the driven transportation roller 50*b* which follows the motion of the main transportation roller 50*a*, and is transported to the recording unit 46 on the downstream side of the transportation direction.

The recording unit 46 is configured to include a medium supporting member 52 which supports the recording medium from the lower side thereof and a below-described recording head 54 provided so as to oppose the upper side of the medium supporting member 52. The head unit 34 is driven by a head unit motor (not illustrated) in a main scanning direction which is a predetermined direction (in FIG. 2, x direction perpendicular to the drawing sheet). In addition, on the bottom surface portion of the head unit 34, recording head 54 is provided which ejects the ink toward the recording medium.

Furthermore, the head unit 34 includes a detachably attachable relay adapter 56 (refer to FIG. 3). The relay adapter 56 includes an extending section 58 protruded from the head unit 34. Each one end side of the ink tubes 36 is connected to the extending section 58. In this way, the ink is supplied from the ink containing unit 40 to the recording head 54 on the head unit 34 via the extending section 58 and the relay adapter 56. The ink is ejected from the ejecting nozzle (not illustrated) on the recording head 54 toward the recording medium positioned between the recording head 54 and the medium supporting member 52.

At the downstream side of the recording unit 46, a pair of discharge rollers 60 is provided. The discharge rollers 60 are configured to include a drive roller 60*a* driven by a discharge motor (not illustrated) and a driven roller 60*b* supported by a support member 62 extended in the width direction and driven by a motion of the drive roller 60*a*.

In addition, the partitioning member 30 is provided at the front side of the support member 62 and the tube arrangement region 32 is formed at the upper part of the partitioning member 30. A corner portion at the lower side of the rear end 64 of the partitioning member 30 is chamfered such that the recording medium is not stuck into the partitioning member 30 to be jammed, that is, a guide shape is provided. Moreover, instead of the guide shape, another method for preventing the recording medium from being stuck into the rear end 64 may be provided.

Furthermore, the ink tube 36 connected to the extending section 58 of the head unit 34 is guided to the guide section 66 of the head unit 34, and passes through the upper part of the support member 62. Then, the ink tube 36 is placed on the upper surface 68 of the partitioning member 30. Then, the tube arrangement region 32 is extended to the front surface 16 side of the printer 10 along the upper surface.

In addition, the recording medium recorded at the recording unit 46 is transported from the recording unit 46 to the downstream side and to the pair of discharge rollers 60. The recording medium transported to the discharge rollers 60 is pinched between the drive roller 60*a* and the driven roller 60*b* and is discharged to the downstream side of the transportation direction than the discharge rollers 60. Then, the recording medium is discharged to the front of the housing 38 from the discharge port 18 via the lower part of the partitioning member 30.

FIG. 3 illustrates a state where the scanner unit 14 of the printer 10 is opened. The housing 38 includes an opening section 72, and a part of the reciprocation region of the head unit 34 is exposed by the opening section 72. The housing 38 includes cover sections 70 at both sides of the opening section 72. Thus, a part of or the entirety of the head unit 34 is covered by the cover section 70 when the head unit 34 is positioned at both end portions of the reciprocation region. In addition, the opening section 72 allows an access from the outside to the internal space of the housing 38.

Furthermore, when the head unit 34 reciprocates in the main scanning direction, since the ink tube 36 is placed on an upper surface 68 of the partitioning member 30, the ink tube 36 can move over the upper surface 68 following the movement of the head unit 34. In addition, since the ink tube 36 passes through the upper part of the partitioning member 30, a possibility of a discharge failure of the recording medium discharged from the discharge rollers 60 toward the discharge port 18 may be reduced.

As described above, according to the invention, the ink tube 36 that leads the ink from the ink containing unit 40 to the recording head 54 protrudes to the outside of the apparatus from the front surface side of the apparatus. Accordingly, the ink tube 36 extended to the outside of the apparatus can be easily visible by a user. More specifically, for example, in a case where the ink tube 36 protrudes to the outside of the apparatus from the rear side of the apparatus, a risk of the ink tube 36 being crushed by an object located around the apparatus may be increased. However, as described above, since the ink tube 36 protrudes to the outside of the apparatus from the front surface side of the apparatus, the risk of the ink tube 36 being crushed by an object located around the apparatus can be decreased. Thus, it is possible to maintain the ink tube 36 in a proper state. This is similar to other embodiments described below.

Furthermore, as modification examples of the embodiment, the ink tube 36 may be configured to be adhesively bonded to the upper surface 68 of the partitioning member 30, or may be configured to be fixed with an adhesive member such as an adhesive tape, or may be configured to be held by a holding member such as a hook.

[Second Embodiment]

Referring to FIG. 4, a printer 74 according to the second embodiment is illustrated. The difference from the first embodiment is in that the ink tube 36 is fixed along the side wall 76 of the left side forming the discharge port 18 without using the partitioning member 30.

The ink tube 36 extended from the extending section 58 of the head unit 34 is guided by the guide section 66 to extend along the main scanning direction. Then, the ink tube 36 changes the direction to the front surface 16 side of the printer 10 and is adhesively bonded to the side wall 76 of the left side to be disposed along the side wall 76 of the left side. In addition, the ink tube 36 is extended to the front from the discharge port 18 along the side wall 76 of the left side. Then, the ink tube 36 curves and changes the direction toward the left to extend to the front surface 16 of the housing 38 and adhesively bonded to the front surface. Then, the ink tube 36 is extended to the left side of the housing 38 and the other end side thereof is connected to each of the ink containing units 40*a*, 40*b*, 40*c* and 40*d*.

Furthermore, as another embodiment, the ink tube 36 may be configured to be fixed to the side wall 76 of the left side forming the discharge port 18 by an adhesive member such as an adhesive tape, or may be configured to be supported by a support member such as a hook, or may be configured to be fixed to a plate-shaped member provided on the side wall 76 of the left side. In addition, as another embodiment, without using the guide section 66, the ink tube 36 may be configured to be extended from the extending section 58 and to be fixed to the side wall 76 of the left side so as to be along the side wall 76 of the left side.

[Third Embodiment]

Referring to FIG. 5, a printer 80 according to the third embodiment is illustrated. The difference from the first embodiment is in that a tube arrangement region 86 is formed between a partitioning member 82 extending in the vertical direction and a side wall 84 of the left side forming the discharge port 18.

In the inner side of the discharge port 18, a plate-shaped partitioning member 82 is provided in a direction along the vertical surface, that is, extending in the vertical direction. The partitioning member 82 opposes the side wall 84 of the left side forming the discharge port 18. Between the partitioning member 82 and the side wall 84 of the left side, the tube arrangement region 86 is formed.

Furthermore, the gap between the partitioning member 82 and the opposing side wall 88 of the right side is set to be larger than the width of the recording medium. In addition, although not illustrated, a sheet discharge port side corner portion of the rear end 90 of the partitioning member 82 is chamfered such that the recording medium is not stuck into the partitioning member 82 to be jammed, in other words, a guide shape is provided. Moreover, instead of the guide shape, other method for preventing the recording medium from being stuck into the rear end 90 may be provided.

The ink tube 36 extended from the extending section 58 of the head unit 34 is guided to the guide section 66 to extend along the main scanning direction, and changes the direction toward the front of the housing 38. Then, the ink tube 36 passes through the tube arrangement region 86 between the partitioning member 82 and the side wall 84 of the left side. In addition, the ink tube 36 is extended to the front of the discharge port 18 through the tube arrangement region 86. Then, the ink tube 36 curves and changes the direction toward the left side to extend to the front surface 16 of the housing 38 and adhesively bonded thereto. Then, the ink tube 36 is extended to the left side of the housing 38 and the other end side thereof is connected to each of the ink containing units 40*a*, 40*b*, 40*c* and 40*d*.

Furthermore, as another embodiment, the ink tube 36 may be configured to be adhesively bonded to the side wall 84 of the left side or a surface 92 opposing the side wall 84 of the left side of the partitioning member 82, or may be configured to be fixed by an adhesive member such as an adhesive tape, or may be configured to be supported by a support member such as a hook, or may be configured to be fixed to a plate-shaped member provided on the side wall 84 of the left side or on the opposing surface 92.

Furthermore, as another embodiment, without using the guide section 66, the ink tube 36 may be configured so as to be extended from the extending section 58 and to pass through the tube arrangement region 86 between the partitioning member 82 and the side wall 84 of the left side.

[Fourth Embodiment]

Referring to FIG. 6, a printer 94 according to the fourth embodiment is illustrated. The difference from the first embodiment is in that, without using the partitioning member 30, the ink tube 36 is positioned on the lower front of the head unit 34 and regulated by a regulation member 98 mounted on the support member 62 which supports the driven roller 60*b*.

In the inner side of the discharge port 18, on the front of a head unit 96, the support member 62 which supports the driven roller 60*b* is extended along the main scanning direction. On the front side of the support member 62, the regulation member 98 which regulates the position of the ink tube 36 extended from the extending section 58 of the head unit 96.

The regulation member 98 guides the ink tube 36 which is hung down to the front of the head unit 96 after extending from the extending section 58 to the head unit 96, toward a side wall 100 of the left side of the discharge port 18. In addition, the regulation member 98 supports the ink tube 36 in order that the ink tube 36 may not be hung down lower than the regulating member 98 and may not interfere a discharge path of the recording medium to be discharged toward the discharge port 18 from the discharge roller 60.

The ink tube 36 extended from the regulation member 98 is extended along the side wall 100 of the left side and is adhesively bonded to the side wall of the left side. In addition, the ink tube 36 is extended to the discharge port 18 along the side wall 100 of the left side. Then, the ink tube 36 curves and changes the direction toward the left side to extend to the front surface 16 of the housing 38 and is adhesively bonded to the front surface. In addition, the ink tube 36 is extended to the left side of the housing 38 and the other end side thereof is connected to each of the ink containing units 40*a*, 40*b*, 40*c* and 40*d*.

Furthermore, as another embodiment, the ink tube 36 may be configured to be fixed to the side wall 100 of the left side of the discharge port 18 by an adhesive member such as an adhesive tape, or may be configured to be supported by a support member such as a hook, or may be configured to be fixed to a plate-shaped member provided on the side wall 100 of the left side.

In the first to fourth embodiments, the ink tube 36 is configured to be adhesively bonded to the front surface 16 of the housing 38. However, as another embodiment, the ink tube 36 may be configured to be fixed to the front surface 16 of the housing 38 by an adhesive member such as an adhesive tape, or may be configured to be supported to the front surface 16 by a support member such as a hook, or may be configured to be fixed to a plate-shaped member provided on the front surface 16.

[Fifth Embodiment]

Referring to FIG. 7, a printer 102 according to the fifth embodiment is illustrated. The characteristics of the embodiment is, as is different from each embodiment described above, that the panel unit is provided on the main body side of the apparatus instead of a scanner unit. More specifically, the printer 102 includes a printer apparatus main body 104 and a scanner unit 106 rotatably mounted on the upper part of the printer. The printer apparatus main body 104 includes a housing 108 which configures an external appearance thereof.

The housing 108 includes a discharge port 112 which discharges the recording medium and a panel unit 114, on the front side of the front-rear direction of the printer 102, that is, on the front surface 110 of the housing 108. A lower end of the panel unit 114 configures an upper edge 116 of a discharge port 112. In the panel unit 114, a plurality of input means 118 for users to use for the operation of the printer 102 is provided, and configures an operation unit 120 of the printer 102.

The housing 108 includes an opening section 124, and a part of the reciprocation region of a head unit 126 is exposed by the opening section 124. The housing 108 includes cover sections 122 at both sides of the opening section 124. Thus, a part of or the entirety of the head unit 126 is covered by the cover section 122 when the head unit 126 is positioned at both end portions of the reciprocation region. In addition, the opening section 124 allows an access from the outside to the internal space of the housing 108.

A plurality of flexible ink tubes 128, one end side of which is connected to the head unit 126 capable of reciprocating in the main scanning direction, provided in the housing 108, is guided by a guide section 130 and is adhesively bonded and mounted on the upper edge 116 of the discharge port 112, that is, the lower end of the panel unit 114. The ink tube 128 is extended to the front of the housing 108 from the upper edge 116 of the discharge port 112, and curves and changes the direction toward the left side. Then, the ink tube 128 is extended to a front surface 110 of the housing 108 to be adhesively bonded to the front surface.

At the separated position on the outer side of the housing 108, external ink containing units 132*a*, 132*b*, 132*c* and 132*d* are provided. The ink tubes 128 are extended to the left side along the front surface 110 of the housing 108 and the other side thereof are connected to the ink container units 132*a*, 132*b*, 132*c* and 132*d*, respectively.

The ink tube 128 may be configured to be fixed to the lower end of the panel unit 114 by an adhesive member such as an adhesive tape, or may be configured to be supported by a support member such as a hook, or may be configured to be fixed to a plate-shaped member provided on the upper edge 116.

[Sixth Embodiment]

Figure 8:
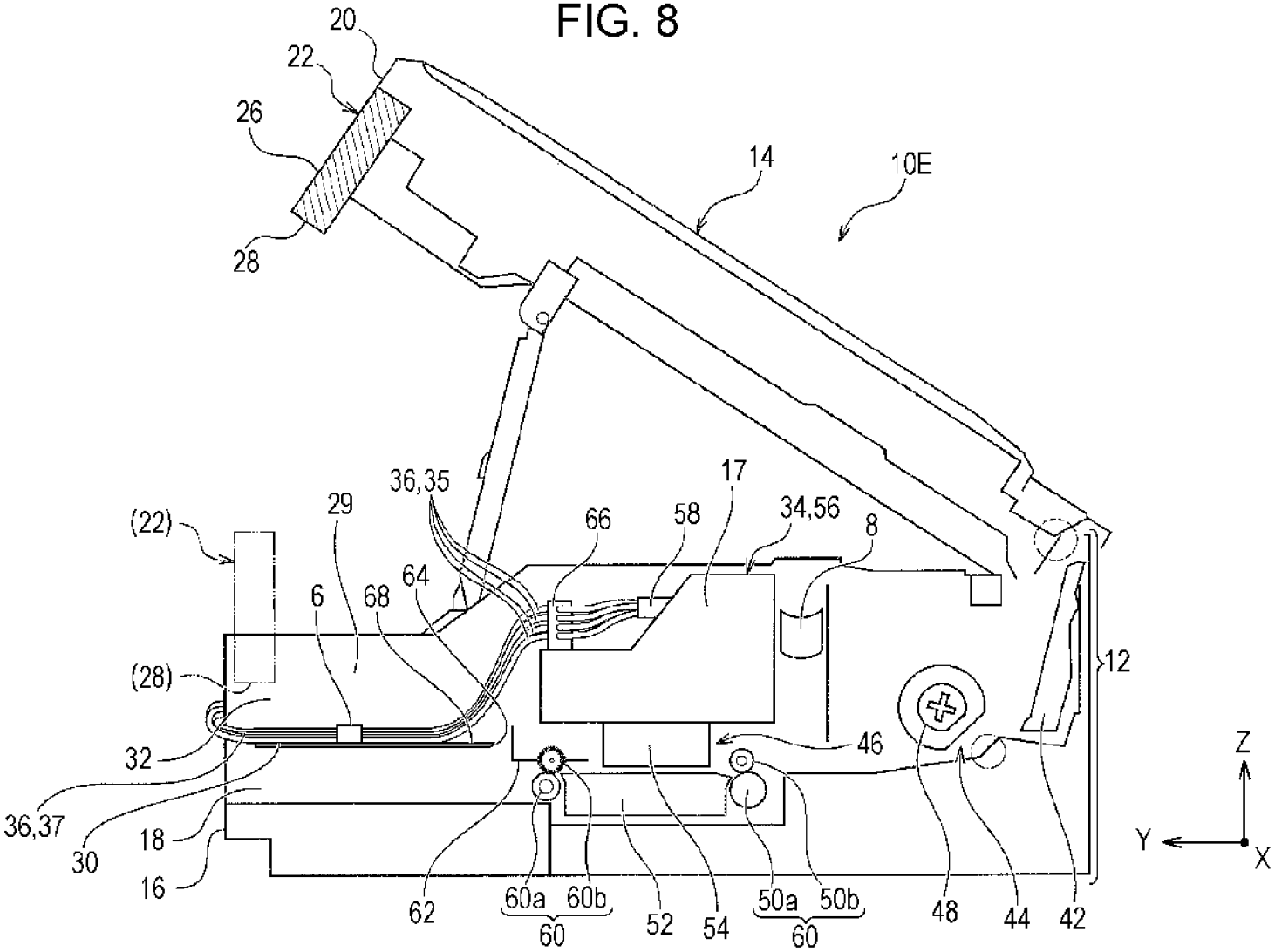
FIG. 8 is a sectional side view illustrating a schematic of inside of the ink jet printer according to the sixth embodiment.
Figure 9:
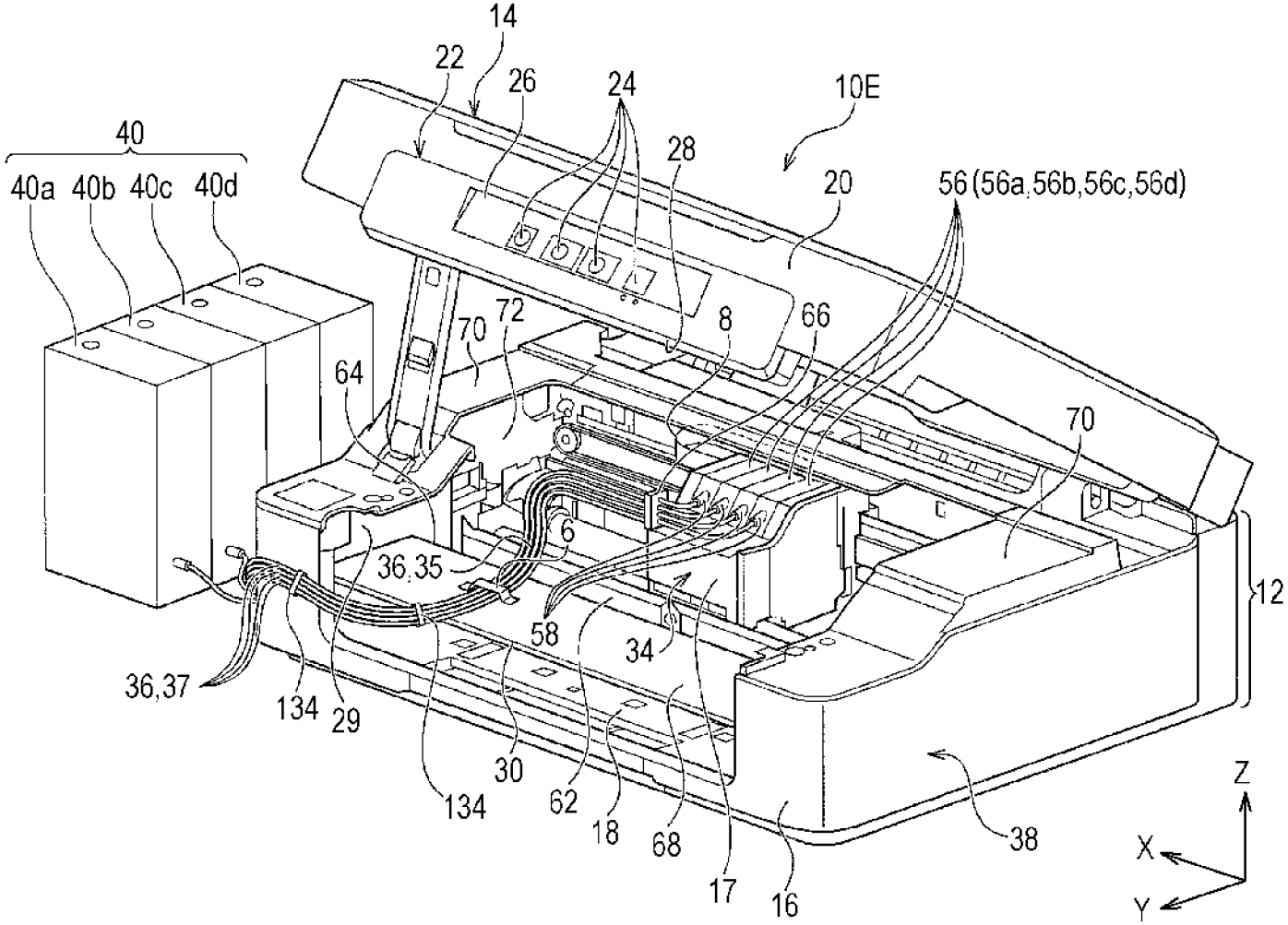
FIG. 9 is a perspective view illustrating an extending form of the ink tube extending from the housing in the sixth embodiment.

FIG. 8 is a sectional side view illustrating a schematic of the inside of a printer 10E according to the sixth embodiment, and FIG. 9 is a perspective view illustrating an extending form of the ink tube extended from the housing in the sixth embodiment. The printer 10E includes a flexible data line (a flexible flat cable, FFC) 8 which sends a data signal to the head unit 34 for performing the recording.

Furthermore, the printer 10E includes an ink tube 36, the both ends of which are connected to the ink containing unit 40 that contains the ink and the head unit 34. Then the ink tube 36 having flexibility leads the ink in the ink containing unit 40 to the recording unit 54. The ink tube 36 includes a deformed movable section 35 which is deformed in accordance with the movement of the head unit 34 and a non-movable section 37 which is not deformed.

In the embodiment, the deformed movable section 35 of the ink tube 36 shows a configuration to be inverted and deformed in the horizontal surface on the front side of the head unit 34, but not limited thereto. The deformed movable section 35 may be configured to be inverted and deformed in the vertical surface, or may be configured to be inverted and deformed in the vertical surface on the upper part of the head unit 34.

In addition, when a side where the discharge port 18 is provided is referred to as a front side of the apparatus, the data line 8 is provided on the rear side with respect to the head unit 34 and the ink tube 36 is provided on the front side with respect to the head unit 34, and the non-movable section 37 protrudes to the outside of the apparatus from the front surface of the apparatus. In the embodiment, the non-movable section 37 of the ink tube 36 protrudes to the outside of the apparatus from the discharge port 18.

A reference sign 6 indicates a fixture which forms a movable side end section of the deformed movable section 35 of the ink tube 36. With the movable side end section 6 as a boundary, the head unit 34 side of the ink tube 36 is the deformed movable section 35 and the ink containing unit 40 side thereof is the non-movable section 37.

Furthermore, as the fixture for forming the movable side end section 6 for fixing the ink tube 36, various fixing structures such as a fixture using a string or a rubber band, a fixture using other member such as a clip and fixing by an adhesive bonding can be used. The plurality of ink tubes 36 can be bound by the string, the rubber band or the clip as a binder 134 in an appropriate position.

The discharge port 18 is vertically partitioned by the tube support member 30 provided at such a position that does not interfere with the discharging of the recording medium, and a part of the non-movable section 37 of the ink tube 36 is supported by the tube support member 30 and protrudes to the outside of the apparatus from the discharge port 18.

In the embodiment, the tube support member 30 is a plate-shaped member forming a surface along the horizontal surface, and the tube arrangement region 32 is formed by the tube support member 30 on the upper part of the discharge port 18. In addition, the panel unit 22 is mounted on the scanner unit 14. In other words, in the discharge port 18, there is provided the plate-shaped tube support member 30 extended in a direction along the horizontal surface, that is, the width direction (X axis direction in FIG. 9) of the printer 10E. The tube support member 30 partitions the discharge port 18 in a vertical direction of the printer 10E (Z axis direction in FIG. 9), and forms the tube arrangement region 32 neighboring the discharge port 18.

The ink tube 36 extended from the head unit 34 is extended to the outer side of the printer 10E from the front surface 16 side of the printer apparatus main body 12 after passing the tube arrangement region 32.

The non-movable section 37 of the ink tube 36 extended to the outer side of the printer 10E changes the direction to the left side and is extended to the left side of the printer 10E after passing along the front surface 16 of the printer apparatus main body 12. The other end sides of the non-movable section 37 of the ink tube 36 extended to the left side of the printer 10E are connected to the ink containing units 40, respectively.

Since the other configurations are similar to those of the first embodiment, with the same reference signs to the same parts, a description thereof will not be repeated.

According to the embodiment, since the non-movable section 37 of the ink tube 36 passes through the upper part of the tube support member 30, a possibility of a discharge failure of the recording medium discharged from the discharge roller 60 toward the discharge port 18 may be reduced. In addition, the ink tube 36 that leads the ink from the ink containing unit 40 to the recording head 54 protrudes to the outside of the apparatus from the front surface 16 of the apparatus. Accordingly, the ink tube 36 extended to the outside of the apparatus can be easily visible to the user. More specifically, for example, in a case where the ink tube 36 protrudes to the outside of the apparatus from the rear side of the apparatus, a risk of the ink tube 36 being crushed by an object located around the apparatus may be increased. However, as described above, since the ink tube 36 protrudes to the outside of the apparatus from the front surface side of the apparatus, the risk of the ink tube 36 being crushed by an object located around the apparatus can be decreased. Thus, it is possible to maintain the ink tube 36 in a proper state.

Furthermore, as modification examples of the embodiment, the ink tube 36 may be configured to be adhesively bonded to the upper surface 68 of the tube support member 30, or may be configured to be fixed with an adhesive member such as an adhesive tape, or may be configured to be held by a holding member such as a hook.

[Other Variations of Each Embodiment]

1. In addition, in the printers 10, 10E, 74, 80, 94 and 102 in the first to sixth embodiments, the ink tube 36 or 128 is bound by a binder 134 between the head unit 34 or 126 and the external ink containing unit 40 or 132 in order to put together the plurality of ink tubes 36 or 128. The binder 134 is a binding band formed of plastic or a rubber-shaped member. The position where the binder 134 is provided is not limited to the position illustrated in the Figures, and the binder 134 may be provided on the other position. The number of the binders 134 is also not limited to the number illustrated in Figs, and may be increased or decreased appropriately.

2. In addition, in the printers 74, 80 and 94 in the second to fourth embodiments, instead of the configuration in which the ink tube 36 is disposed along the side wall 76, 84 or 100 of the left side forming the discharge port 18, a configuration in which the ink tube 36 is disposed along the side wall of the right side forming the discharge port 18 may be adopted.

3. In addition, in the printers 10, 74, 80, 94 and 102 in the first to fifth embodiments, the ink tube 36 or 128 is configured to be extended to the left side of the housing 38 or 108 from the housing. However, the ink tube 36 or 128 may be configured to be extended to the right side of the housing 38 or 108 from the housing.

4. In addition, as another embodiment, in the printers 10, 74, 80, 94 and 102, the external ink containing unit 40 or 132 may be configured to be provided at the separated position on the right side of the housing 38 or 108. A configuration may be adopted in which the external ink containing units 40*a* and 40*b*, or 132*a* and 132*b* are configured to be disposed on the right side of the housing 38 or 108, and the external ink containing units 40*c* and 40*d*, or 132*c* and 132*d* are disposed on the left side of the housing 38 or 108. Moreover, the external ink containing unit 40 or 132 may be configured to be provided integrally on the side surface of the housing 38 or 108.

Furthermore, the invention is not limited to above described embodiments. Various modifications can be obtained within the scope of the invention as disclosed Claims. It is needless to say that those modifications will be also included in the scope of the invention.

REFERENCE SIGNS LIST

10, 10E, 74, 80, 94, 102: printer
8: data line
12, 104: printer apparatus main body
14, 106: scanner unit
16, 110: front surface of printer apparatus main body
18, 112: discharge port
20: front surface of scanner unit
22, 114: panel unit
24, 118: input means
26, 120: operation unit
28, 116: upper edge of discharge port
30, 82: partitioning member
32, 86: tube arrangement region
34, 96, 126: head unit
36, 128: ink tube
38, 108: housing
40, 40*a*, 40*b*, 40*c*, 40*d*, 132*a*, 132*b*, 132*c*, 132*d*: external ink containing unit
42: hopper
44: feed unit
46: recording unit
48: feed roller
50: transportation roller
50*a*: main transportation roller
50*b*: driven transportation roller
52: medium supporting member
54: recording head
56: relay adapter
58: extending section
60: discharge roller
60*a*: drive roller
60*b*: driven roller
62: support member
64, 90: rear end of partitioning member
66, 130: guide section of head unit
68: upper surface of partitioning member
70, 122: cover section
72, 124: opening section
76, 84, 100: side wall of left side
88: side wall of right side
92: opposing surface
98: regulation member
134: binder The entire disclosure of Japanese Patent Application No. 2012-045109 filed on Mar. 1, 2012, and No. 2012-041920 filed Feb. 28, 2012, are expressly incorporated by reference herein.

The invention claimed is:

1. An ink jet recording apparatus comprising:

a head unit provided with a recording head ejecting an ink and capable of moving in a predetermined moving direction;

a discharge port including a recording medium discharge region wherein a discharger discharges the recording medium on which a recording is performed to the discharge port, wherein the discharger is configured to include a drive roller and a driven roller which is in contact with the drive roller, and wherein the ink tube protrudes to the outside of the apparatus through the upper area of a support member which supports the driven roller.

an ink tube having flexibility, that is connected to the head unit and leads the ink from an ink containing unit outside of a housing which configures an external appearance of the apparatus to the head unit.

2. The ink jet recording apparatus according to claim 1, wherein a regulation member which regulates the position of the ink tube is provided on the support member.

3. The ink jet recording apparatus according to claim 1, wherein the ink tube is supported by a side wall configuring the discharge port.

4. The ink jet recording apparatus according to claim 1, wherein a plurality of the ink tubes are provided, and wherein the plurality of ink tubes are bound together by a binder.

5. The ink jet recording apparatus according to claim 1, wherein when a flexible data line which sends a data signal for performing the recording to the head unit is provided and the side where the discharge port is provided is used as a front side of the apparatus, the data line is disposed on the rear side with respect to the head unit, and the ink tube is disposed on the front side with respect to the head unit and protrudes to the outside of the apparatus from the front surface of the apparatus.

6. The ink jet recording apparatus according to claim 1, wherein a tube support member supporting the ink tube in contact with a part of the ink tube is present, at a rear side of a panel unit of the housing, and wherein the ink tube is supported by the tube support member and protrudes to the outside of the apparatus.

7. The ink jet recording apparatus according to claim 6, wherein the discharge port is vertically or horizontally partitioned by the tube support member provided at such a position where discharging the recording medium is not interfered with, and wherein a part of the ink tube is supported by the tube support member and protrudes to the outside of the apparatus.

8. The ink jet recording apparatus according to claim 7, wherein the tube support member is a plate-shaped member forming a surface along the horizontal plane, and wherein a tube arrangement region is formed on the upper part of the discharge port by the tube support member.

9. The ink jet recording apparatus according to claim 7, wherein the tube support member is a plate-shaped member forming a surface along the vertical plane, and wherein the tube arrangement region is formed on the left or right side of the discharge port by the tube support member.

10. The ink jet recording apparatus according to claim 1, wherein the ink tube protrudes to the outside of the apparatus from the discharge port.

11. The ink jet recording apparatus according to claim 10, wherein the discharge port is configured to include a space for the recording medium discharge region and a second region which separated from the recording medium discharge region, wherein the ink tube protrudes to the outside of the apparatus from the second region.

12. The ink jet recording apparatus according to claim 1, wherein the discharge port is configured to include a space for the recording medium discharge region and a second region which separated from the recording medium discharge region, wherein the ink tube protrudes to the outside of the apparatus from the second region.

13. The ink jet recording apparatus according to claim 1, wherein the ink tube protrudes to the outside of the apparatus through the upper area of the recording medium discharge region.

14. The ink jet recording apparatus according to claim 1, wherein the ink tube protrudes to the outside of the apparatus through the side area of recording medium discharge region

15. The ink jet recording apparatus according to claim 12, wherein the space for the recording medium discharge region and a second region which separated from the recording medium discharge region are partitioned by a partitioning member.

16. The ink jet recording apparatus according to claim 1, wherein a regulation member which regulates the position of the ink tube is provided on the support member.

17. The ink jet recording apparatus according to claim 1, wherein when a flexible data line which sends a data signal for performing a recording to the head unit is provided and the side where the discharge port is provided is used as a front side of the apparatus, the data line is disposed on the rear side with respect to the head unit, and the ink tube is disposed on the front side with respect to the head unit and protrudes to the outside of the apparatus from the front surface of the apparatus.

* * * * *